US006165307A

United States Patent [19]

Fair et al.

[11] Patent Number: 6,165,307

[45] Date of Patent: Dec. 26, 2000

[54] MULTI-COMPONENT 3-DIMENSIONAL ENERGETICS METHOD AND CONSTRUCTION

[75] Inventors: David Fair, Hackettstown; Eileen Heider, Budd Lake, both of N.J.; Mark J. Mezger, Mount Bethel, Pa.

[73] Assignee: The United States of America as represented by the Secretary of the Army, Washington, D.C.

[21] Appl. No.: 09/038,484

[22] Filed: Mar. 5, 1998

[51] Int. Cl.[7] ..... B32B 31/00; F42B 12/00; F42B 33/00

[52] U.S. Cl. ..... 156/264; 156/267; 156/286; 156/293; 156/308.2; 156/513; 156/563; 83/53; 264/3.2; 264/3.3; 428/67; 149/14; 149/15; 149/16; 149/109.6

[58] Field of Search ..... 149/14, 15, 16, 149/109.6; 83/25, 53; 156/258, 264, 267, 293, 511, 513, 308.2, 285, 286, 563; 264/3.1, 3.2, 3.3; 60/250; 428/67

[56] References Cited

U.S. PATENT DOCUMENTS 778,788 12/1904 Maxim ..... 44/530
3,932,923 1/1976 DiMatteo ..... 29/407.05
5,808,099 9/1998 Stec, III et al. ..... 548/953
5,824,806 10/1998 Stec, III et al. ..... 548/953
5,824,807 10/1998 Dave et al. ..... 548/953

*Primary Examiner*—Linda L. Gray
*Attorney, Agent, or Firm*—John Francis Moran

[57] ABSTRACT

A multi-component three dimensional energetic device and the method of manufacturing it. The method includes the steps of forming a quantity of an energetic material into a plurality of sheets having relatively no appreciable thickness, and then cutting at least one required shape from the surface of a portion of each of the plurality of sheets to define an opening for at least one inlay of a different material. An inlay of the different material is placed in the openings to form a plurality of stackable shapes that are then bonded together to form the multi-component three dimensional energetic device. The preferred embodiment includes forming the inlay from an energetic material that is different from the sheet energetic material. Optionally a bonding agent may be admixed with at least one of the materials to facilitate bonding to form the device. The bonding agent may or may not be an energetic material, as desired. The required shape are preferably cut along three axes of cutting to approximate non axial shapes without substantial step-like deviation from the desired shape.

14 Claims, 2 Drawing Sheets

MULTI-COMPONENT 3-DIMENSIONAL ENERGETICS METHOD AND CONSTRUCTION

The invention described herein may be manufactured, used, and licensed by or for the U.S. Government for U.S. Governmental purposes.

FIELD OF THE INVENTION

The present invention relates to a method of manufacturing improved energetic devices. More particularly the invention relates to a method for making three dimensional multi-component energetic devices.

BACKGROUND OF THE INVENTION

Energetic material is used in a variety of devices. Examples of such are warheads, demolition devices, pyrotechnics, propellants and the like, for use in war as well as in peacetime applications.

Present manufacturing techniques for producing energetic materials in more complicated shapes other than simple squares, rectangles, spheres and cones has, to the present, been a major limitation in the preparation of multicomponent systems. Specifically, the use of several energetic material components in the same device is difficult if the shapes of the two components are not simple.

The use of multiple energetic material components is also limited when the device itself requires unusual or difficult to form shapes. At best, present technology permits the manufacture of multi-component energetic materials only in one or two dimensions, thus substantially limiting the design parameters for many explosive devices.

At the present time, development of multi-component energetic devices has not been attempted because there is no means available to manufacture them. Such devices would be of great advantage to the energetic material industry if they would be possible to enhance the performance of weapon systems.

Examples of systems that would be greatly improved if such a development were to be made include multiple formed penetrators suing a single point of initiation. For example, a precursor slug could be fired in advance of a self forging fragment to defeat armor if multi-component energetic devices existed.

Also, multiple infrared generators would be developed to use in a decoy flare to better simulate the target being protected. In addition, rocket motors might be tailored to have more complex burning rate characteristics with the use of multi-component energetic materials and constructions.

Accordingly, one object of the present invention is to provide an improved manufacturing process for energetic devices.

Another object of this invention is to provide a method for manufacturing multi-component energetic material in three dimensional shapes.

Other objects will appear hereinafter.

SUMMARY OF THE INVENTION

It has now been discovered that the above and other objects of the present invention may be accomplished in the following manner. Specifically, it has now been discovered that a multi-component three dimensional energetic device may be manufactured for the first time.

The method includes the steps of forming a quantity of an energetic material, such as by forming the material between rollers into a two dimensional sheet having relatively no appreciable thickness, followed by cutting the two dimensional sheet into a plurality of individual sheets having a desired two dimensional shape. At least one required interior shape is cut from the surface of a portion of each of the plurality of sheets to define an opening for at least one inlay of a different material. The preferred cutting device is a water jet cutter that is controlled and programmed to cut precise shapes along all three axes.

At least one second plurality of sheets is formed from the different material and cut to form a plurality of inlays of the different material corresponding in shape to the openings in the first plurality of sheets. The plurality of inlays are placed in the respective opening of each of the individual sheets sheet to form a plurality of stackable shapes.

The plurality of stackable shapes are bonded under pressure and temperature to form the multi-component three dimensional energetic device of this invention.

In a preferred embodiment, the inlay is formed from an energetic material that is different from the sheet energetic material. A bonding agent may be admixed with at least one of the materials to facilitate bonding to form the device. The bonding agent itself may be an energetic material if desired, but non energetic bonding agents such as compatible thermoplastic resins are also contemplated for use with the present invention.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
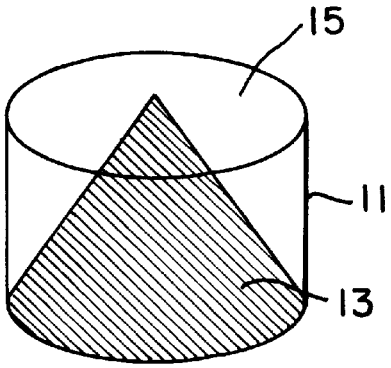
FIG. 1 is a schematic view illustrating one type of monolithic object formed according to the present invention.

The present invention has many advantages over the prior art. In its simplest form the invention comprises a monolithic object formed similar to the formation of a stack of a plurality of disks or sheets, similar to a stack of records. FIG. 1 illustrates a simplified final product 11 where a cone 13 of an energetic material is inside an overall cylindrical shape 15 of another energetic material. While the object 11 is simple in form, prior to the present invention it has been very difficult to manufacture without an enormous amount of hand labor. Even then, the device would have been imperfect.

Figure 2:
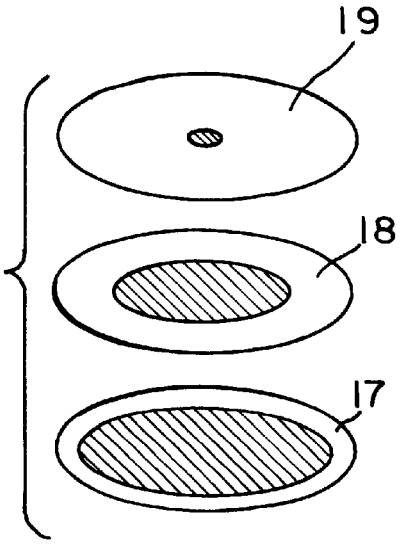
FIG. 2 is a schematic view illustrating three sections taken near the top, middle and bottom of the device illustrated in FIG. 1.

The monolith 11 in FIG. 1 can be visualized as a stack of individual sections very similar to a stack of records. FIG. 2 illustrates three sections 17, 18 and 19 taken from the bottom, middle and top, respectively. Each section is formed by cutting a pattern out of two different materials and inserting the cutout of the internal material into the hole left in the outer material.

Figure 3:
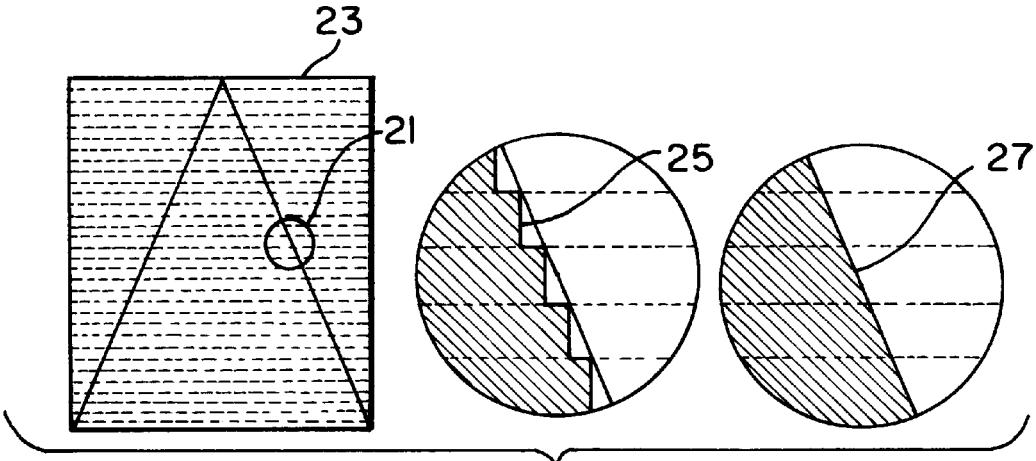
FIG. 3 is a schematic view illustrating the cutting step in which the particular cutting device is adapted to cut on three axes.

The present invention is directed primarily to energetic material that may be formed into sheet material as described below. This material is rolled into a sheet and cut as desired. The preferred cutting device is a numerically controlled water jet cutter. These devices are presently available commercially and can be programmed to cut out extremely complex patterns. They are also programmable to cut in a sequence of patterns that build up into the cone shape shown in FIG. 1. Water jet cutters are capable of cutting on all three axes, making angle cutting relatively easy. The ability to cut at an angle makes it possible to form a perfect cone (or other surface shape) and not a series of steps, as illustrated in FIG. 3, where an enlargement 21 of a section of object 23 illustrates the undesired steps 25 when only two axes of cutting are used and the preferred, desired smooth shape 27 when correct axial cutting is employed. In both enlarged views, the dotted lines represent individual sections as previously shown in FIG. 2.

Figure 4:
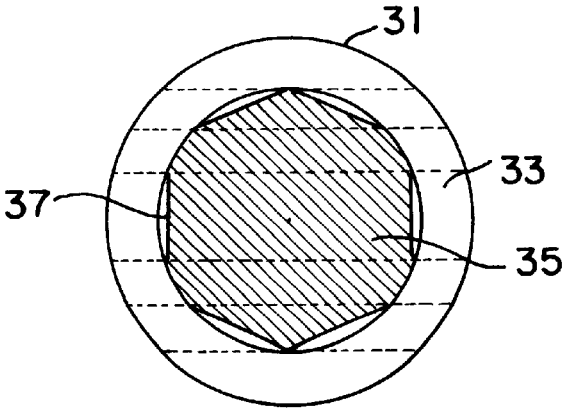
FIG. 4 is a schematic view illustrating the use of cords to assemble a sphere within a sphere as one embodiment.

For the first time it is possible to mold a sphere within a sphere in one molding step, rather than having to form a first sphere and then mold a second sphere around the first one. When the thickness of the sections and the angles of cut are properly varied, using the computer controls of the water jet cutter, the surface of the inner sphere is approximated by a series of cords 37. FIG. 4 illustrates device 31 with outer sphere 33 and inner sphere 35. As the number of layers is increased, the surface of interior sphere 35 can be approximated more accurately.

The monolithic devices of the present invention are assembled by stacking a plurality of disks. It is contemplated that a thermoplastic material may be used as a binder. The various energetic materials may be admixed within a thermoplastic resin and formed into sheets, cut and stacked as described above. Once the layers are formed, heat and pressure is used to form the stack of material into a solid block, preserving the internal design. The thermoplastic binder, along with the energetic materials, is melted and pressed together under vacuum to fuse the layers together. The thermoplastic resin may be energetic or non-energetic. The only constraint is that the thermoplastic material used in each case must be capable of bonding to the other thermoplastic materials without the use of an adhesive.

FIGS. 5*a*–5*g* illustrate a preferred embodiment of the manufacturing process of this invention. After a suitable energetic material is formed FIG. 5*a* into a sheet, such as by melting or the like, the material is rolled to the desired thickness using a roll calendering mill, for example.

Figure 5A:
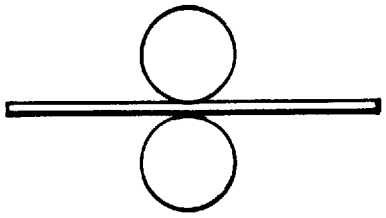
FIGS. 5*a*–5*g* are steps in the process illustrating a preferred embodiment of the invention.
Figure 5B:
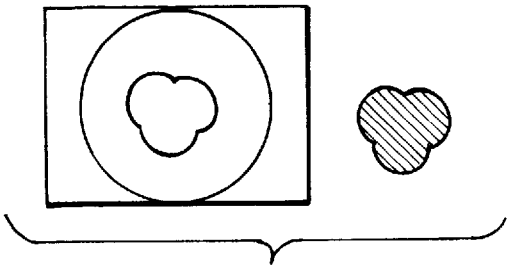
Figure 5C:
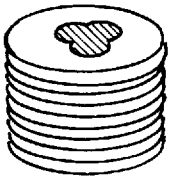
Figure 5D:
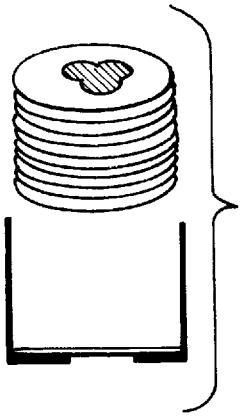

The sheets are then cut FIG. 5*b* by a water jet cutter into the required shapes, using all three axes of orientation for the water jet stream. The shapes are assembled FIG. 5*c* and the resulting sheets of inlayed materials are stacked. The stack is placed FIG. 5*d* into a vessel that also serves as the mold. The mold includes a follower plate at the bottom that is later used to extract the block from the mold.

Figure 5E:
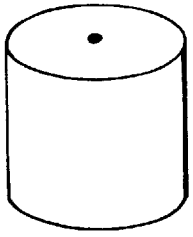
Figure 5F:
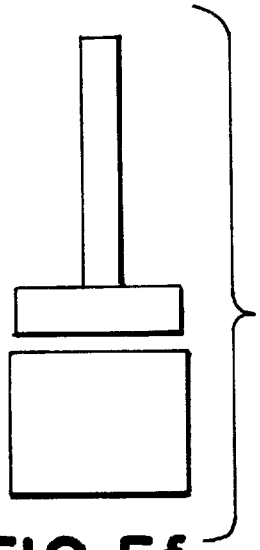
Figure 5G:
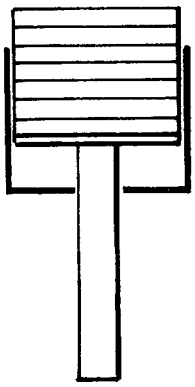

The mold vessel FIG. 5*e* is heated in an oven to a uniform temperature slightly above the melting point. A vacuum is pulled during the heating process to avoid encasing air pockets. A ram press FIG. 5*f* is then used to force the stack together under pressure. The dwell time used needs to be sufficient to ensure welding all the layers together. A vacuum is also pulled just prior to and during the early phase of the pressing operation to remove gases and eliminate voids. The mold is allowed to cool under controlled condition to relax the internal stresses. The block is then ejected from the mold FIG. 5*g* by pressing the follower plate from the bottom of the mold.

A number of variations of the process are possible. For example, the mold may be used as part of the lay-up to leave a shape embossed into the final three dimensional block of energetic material. This shape could be used to accommodate a fuse package or a liner. Tabs or dimples may also be built in to assist in assembly. Also, a component from the device being formed may be used to help form the stack. When the block is formed the energetic material will then be bonded to the component, thus ensuring efficient transfer of energy to the component.

In practice, the monolith block can be formed to near net shape. The near net shape would then be inserted into a warhead and, using heat and pressure, the material may be then formed to fill all the solids of the cavity and bond to the surface.

The basic shapes described herein are merely a suggestion of the myriad of possible shapes. A number of different energetic materials may be used to tailor performance. Some formulations may be used to speed detonation or burning and others can be used to delay detonation or burning. The approach of the detonation or burning or detonation front can be timed using different energetics and wave shaping to obtain the desired effects. A precursor can be formed and allowed to contact a target in advance of a slug. Inert solids can be inserted in the matrix or a void can be built into the matrix.

While particular embodiments of the present invention have been illustrated and described herein, it is not intended that these illustrations and descriptions limit the invention. Changes and modifications may be made herein without departing from the scope and spirit of the following claims.

We claim:

1. A method for the preparation of a multi-component three dimensional energetic device which comprises the steps of (a) forming a quantity of an energetic material into a plurality of sheets;

(b) cutting at least one required shape from the surface of a portion of each of said plurality of sheets to define an opening for insertion of at least one inlay therein comprising an energetic material;

(c) placing said inlays in said openings, so resulting in the formation of a plurality of stackable shapes; and (d) bonding together said plurality of stackable shapes to form the multi-component three dimensional device.

2. Method in accordance with claim 1 wherein the inlays placed in said openings comprises an energetic material which is different from the energetic material of the sheets.

3. The method of claim 1, which includes the step of admixing a bonding agent with at least one of said materials to facilitate bonding to form said device.

4. The method of claim 3, wherein said bonding agent is an energetic material.

5. The method of claim 3, wherein said bonding agent is not an energetic material.

6. The method of claim 1, which includes the step of cutting said required shape along three axes of cutting to approximate non axial shapes.

7. A method for the preparation of a multi-component three dimensional energetic device which comprises the steps of (a) forming a quantity of an energetic material by calendaring into a sheet;

(b) cutting said sheet into a plurality of individual sheets;

(c) cutting at least one required interior shape from the surface of a portion of each of said plurality of sheets by a controlled water jet on to said surface thereby defining an opening therein for insertion of at least one inlay comprising an energetic material;

(d) forming at least one secondary sheet from an energetic material and cutting said secondary sheet to form the inlays to be inserted in said openings;

(e) placing the inlays in the openings created in each of said sheets, thereby forming a plurality of stackable shapes; and (f) bonding together said plurality of stackable shapes under pressure to form the multi-component three dimensional energetic device.

8. Method in accordance with claim 7 wherein the energetic material of the inlays is different from the energetic material of the calendared sheet.

9. Method in accordance with claim 7 wherein the bonding comprises the steps of (a) forming a stack from said stackable shapes;

(b) heating said stack under vacuum to a uniform temperature slightly above the melting point of said materials;

(c) pressing said stack under sufficient pressure and for sufficient time to ensure welding of the stackable shapes together; and (d) cooling the pressed stack under controlled conditions to substantially relax all internal stresses.

10. The method of claim 7, which includes the step of admixing a bonding agent with at least one of said materials to faciliate bonding to form said device.

11. The method of claim 10 wherein said bonding agent is an energeric material.

12. The method of claim 10 wherein said bonding agent is not energeric material.

13. The method of claim 7,which includes the step of cutting said required shape with said water jet along three axes of cutting to approximate non axial shapes without substantial step-like deviation from the desired shape.

14. The method of claim 7, wherein said bonding step is accomplished in mold.

* * * * *